US007878669B2

(12) United States Patent
Jang et al.

(10) Patent No.: US 7,878,669 B2
(45) Date of Patent: Feb. 1, 2011

(54) KNOB DECO FOR LAUNDRY MACHINE AND MANUFACTURING METHOD THEREOF

(75) Inventors: Ho-Sung Jang, Gyeongsangnam-Do (KR); Chang-Woo Son, Gyeongsangnam-Do (KR); Gil-Yong Lee, Gyeongsangnam-Do (KR); Yong-Min Jeon, Gyeongsangnam-Do (KR); Han-Ki Cho, Gyeongsangnam-Do (KR)

(73) Assignee: LG Electrnics Inc., Seoul (KR)

( * ) Notice: Subject to any disclaimer, the term of this patent is extended or adjusted under 35 U.S.C. 154(b) by 198 days.

(21) Appl. No.: 12/202,783

(22) Filed: Sep. 2, 2008

(65) Prior Publication Data

US 2009/0059561 A1 Mar. 5, 2009

(30) Foreign Application Priority Data

Sep. 3, 2007 (KR) ..... 10-2007-0089179

(51) Int. Cl.
*G01D 11/28* (2006.01)

(52) U.S. Cl. ..... 362/23; 362/89; 362/91; 362/602

(58) Field of Classification Search ..... 362/23, 362/89, 91, 602
See application file for complete search history.

(56) References Cited

U.S. PATENT DOCUMENTS

| | | | | |
|---|---|---|---|---|
| 7,343,680 | B2 * | 3/2008 | Yoon et al. | 29/896.5 |
| 2004/0145884 | A1 | 7/2004 | Orikasa | 362/23 |
| 2007/0119484 | A1 * | 5/2007 | Kwon et al. | 134/58 R |
| 2008/0062673 | A1 | 3/2008 | Hwang et al. | 362/85 |

FOREIGN PATENT DOCUMENTS

| | | |
|---|---|---|
| CN | 1888226 | 1/2007 |
| CN | 1888240 | 1/2007 |
| KR | 10-2006-0001156 A | 1/2006 |
| KR | 10-2006-0008505 A | 1/2006 |
| KR | 10-2006-0085811 A | 7/2006 |
| WO | WO 2007/043819 A1 | 4/2007 |

OTHER PUBLICATIONS

European Search Report dated Feb. 25, 2009.
Korean Office Action dated Feb. 27, 2009.
Chinese Office Action issued in CN Application No. 200810215153.2 dated Jun. 3, 2010.

* cited by examiner

*Primary Examiner*—Sandra L O Shea
*Assistant Examiner*—Meghan K Dunwiddie
(74) *Attorney, Agent, or Firm*—KED & Associates, LLP

(57) ABSTRACT

A knob deco for a laundry machine is provided. The knob deco may include a knob guard in which a dial knob is inserted, and a lamp window main body mounted at a rear surface of the knob guard. Lamp windows may be formed in the knob guard for transmitting light emitted from a rear side of the knob guard to a front side of the knob guard, and lamp window shielding members may be provided at the lamp windows to partially shield light transmitted through the lamp window.

23 Claims, 5 Drawing Sheets

【Fig.1】
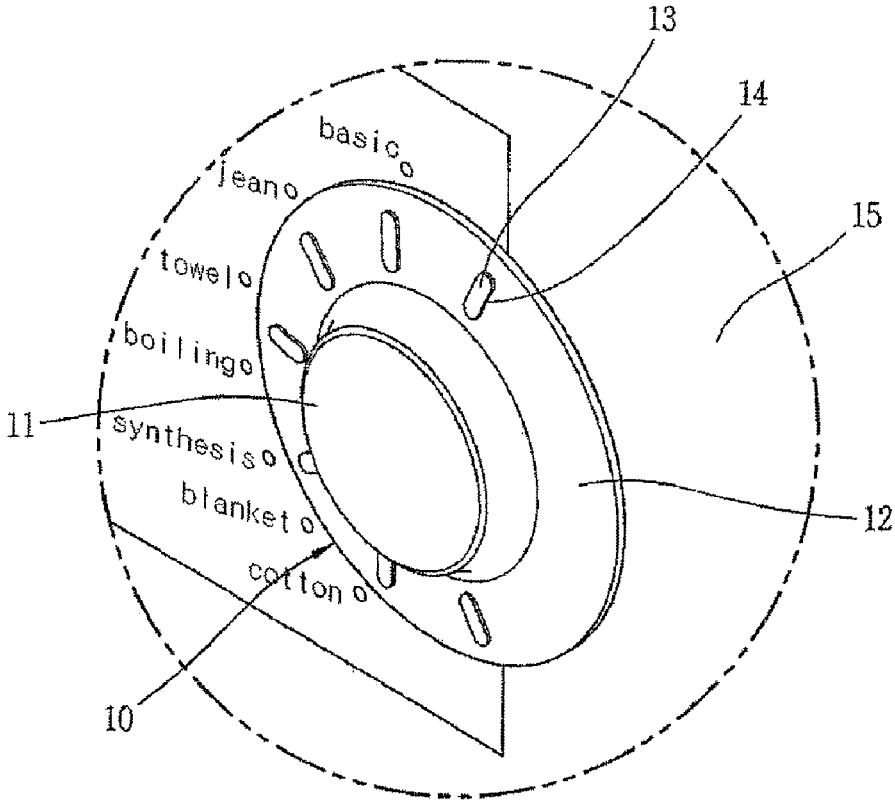
【Fig. 2】
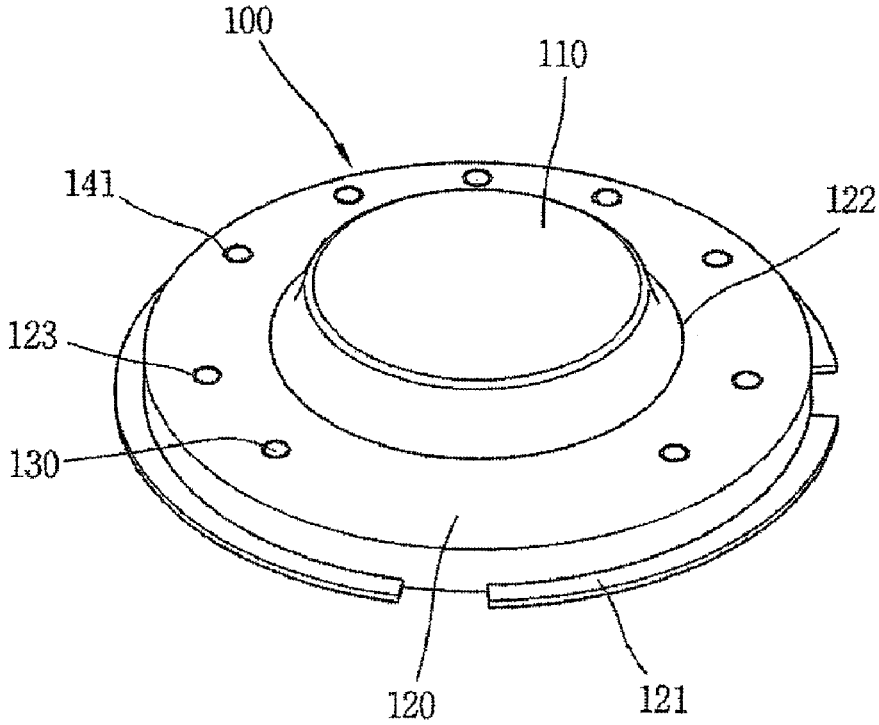

【Fig. 3】
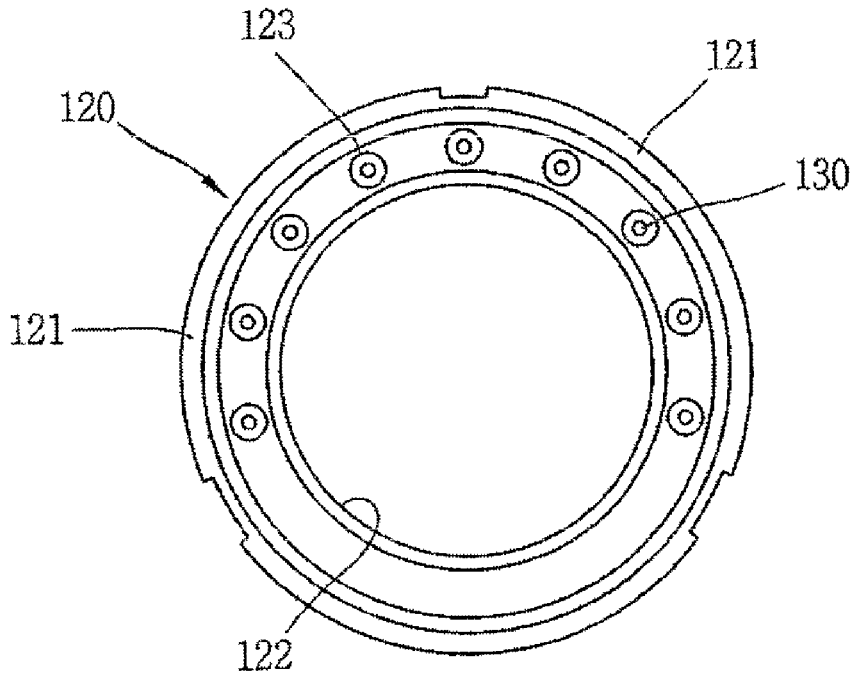
【Fig. 4】
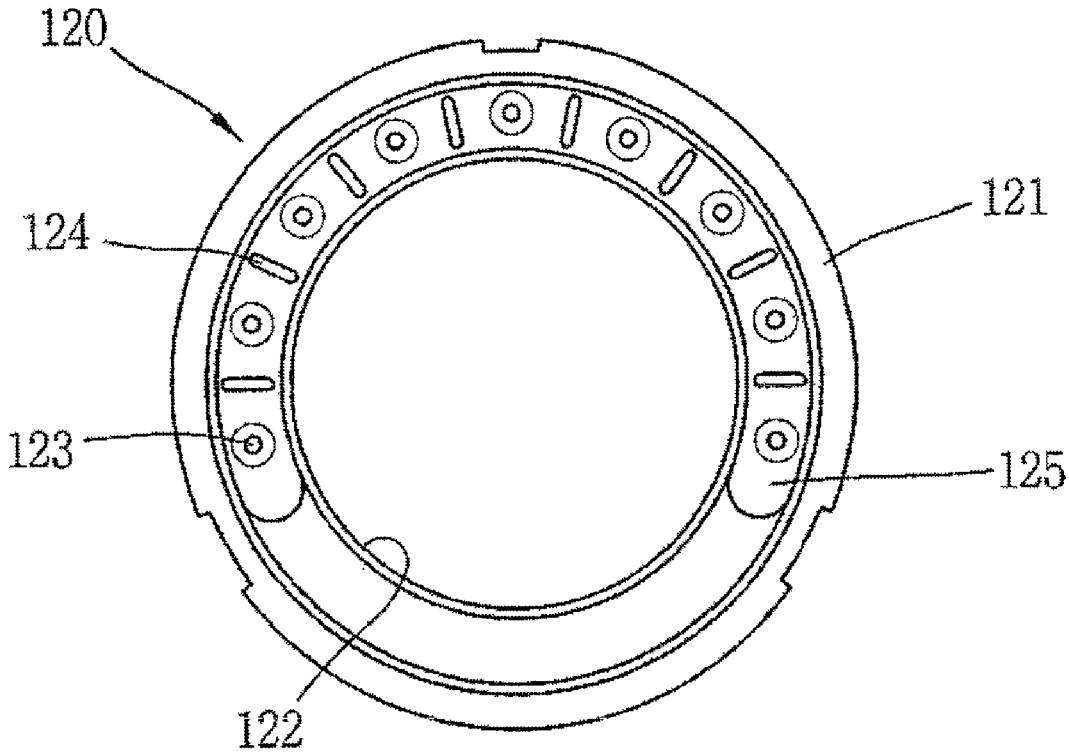

【Fig. 5】
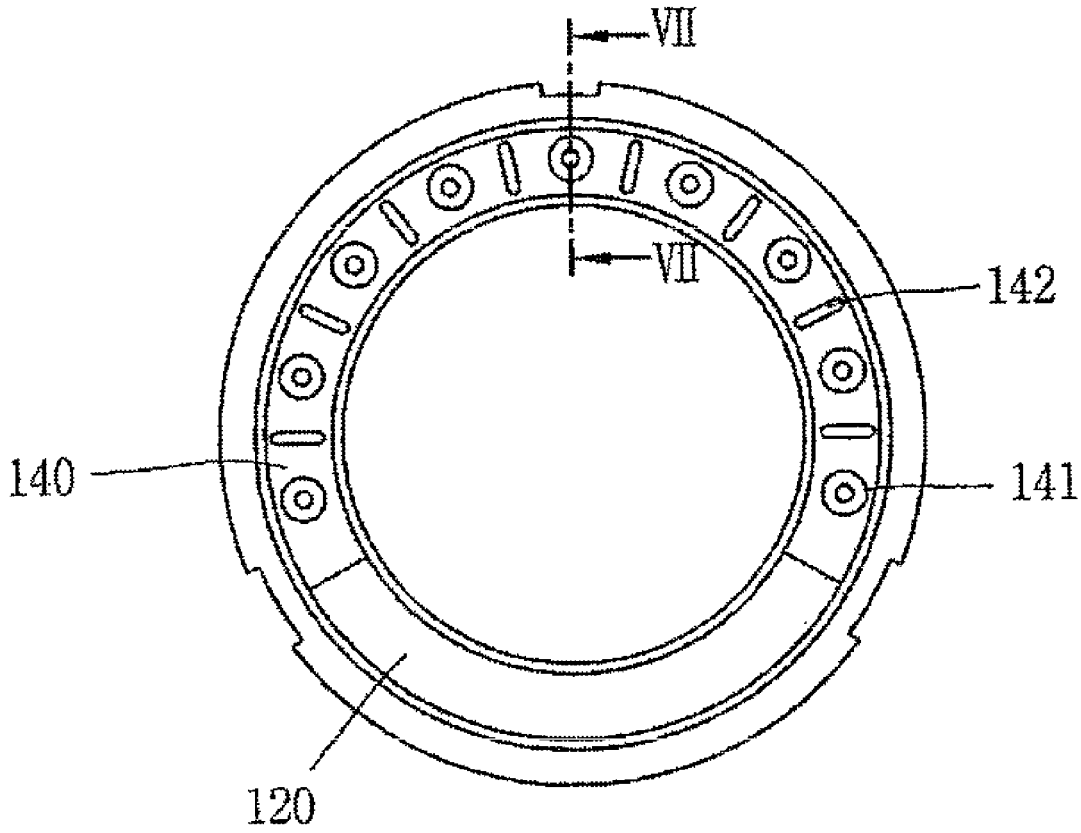
【Fig. 6】
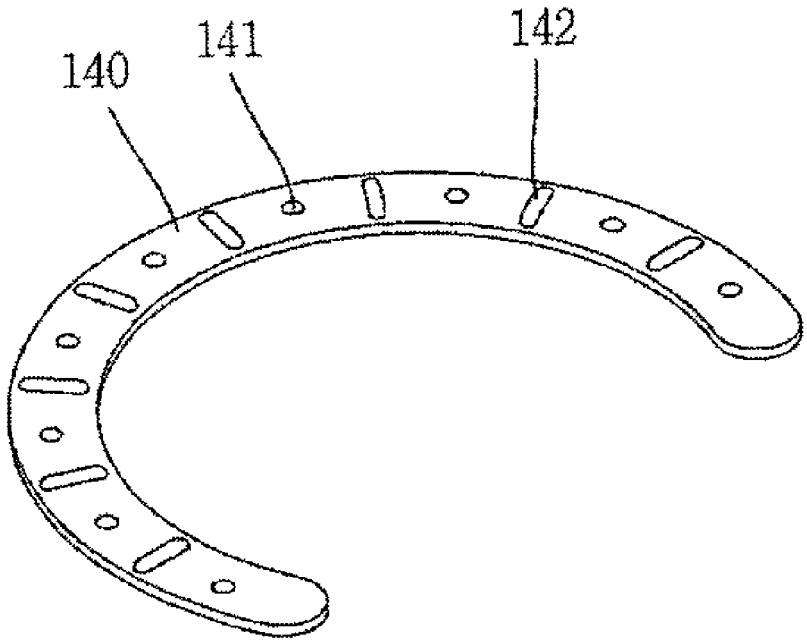

【Fig. 7】
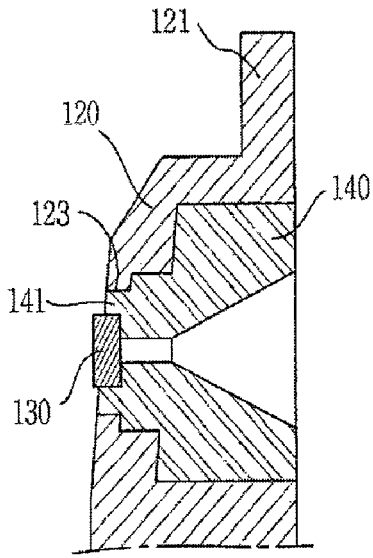
【Fig. 8】
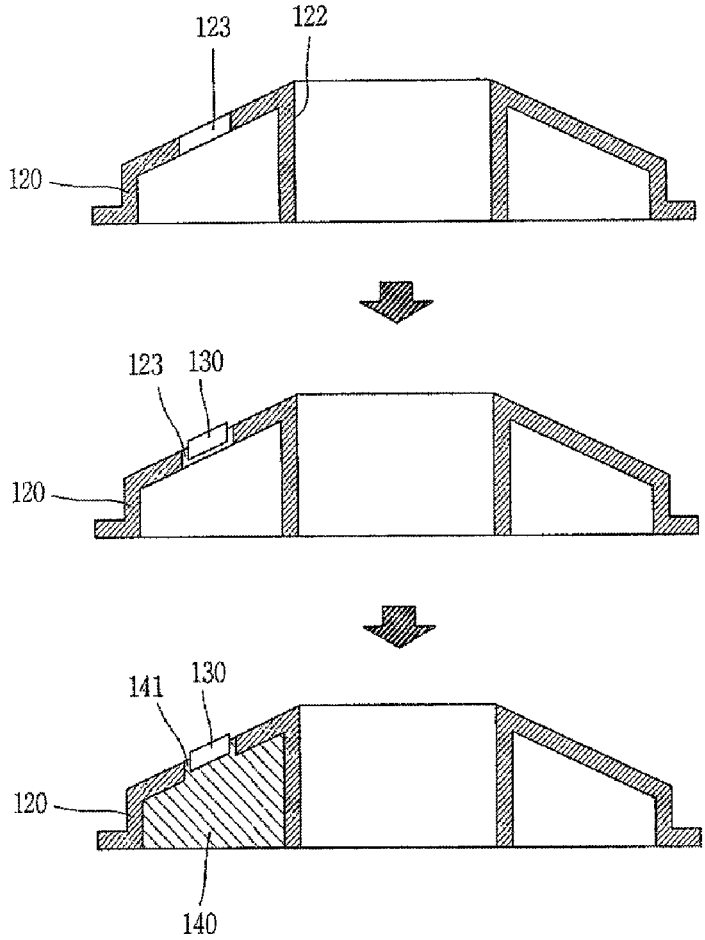

【Fig. 9】
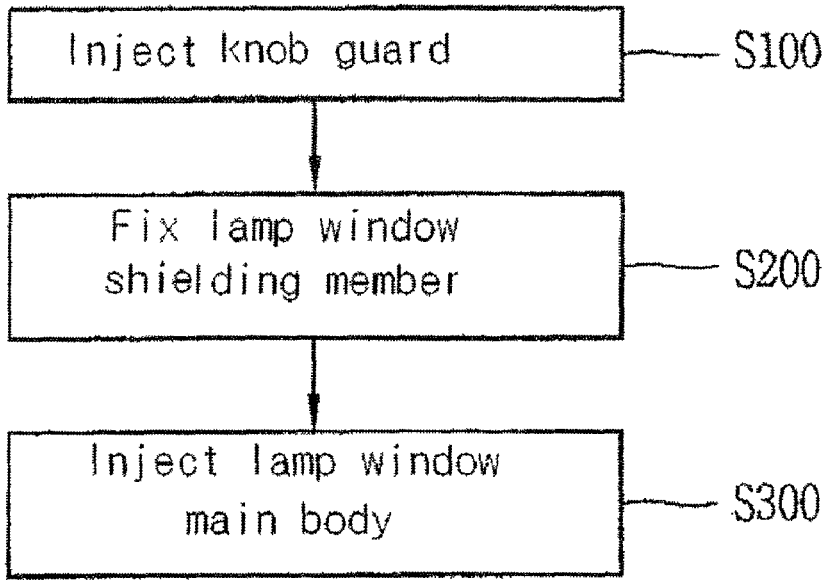
【Fig. 10a】
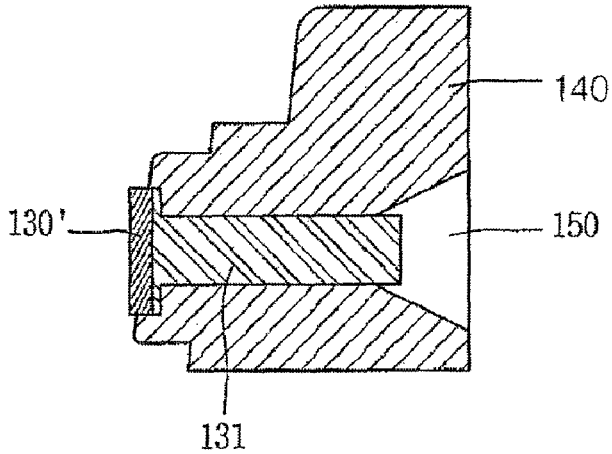
【Fig. 10b】
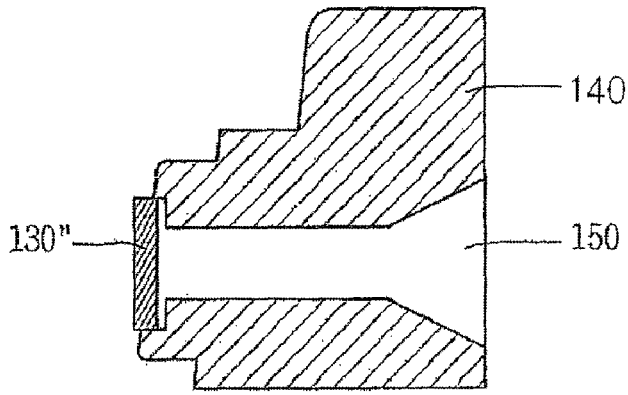

KNOB DECO FOR LAUNDRY MACHINE AND MANUFACTURING METHOD THEREOF

RELATED APPLICATION

The present disclosure relates to subject matter contained in priority Korean Application No. 10-2007-0089179, filed on Sep. 3, 2007, which is herein expressly incorporated by reference in its entirety.

BACKGROUND OF THE INVENTION

1. Field of the Invention

The present invention relates to a laundry machine or washing machine, and particularly, to a knob deco which is disposed at a control panel and has a dial knob for inputting a washing condition, and a manufacturing method thereof.

2. Description of the Related Art

In general, a laundry machine includes a washer (washing machine), a dryer, a refresher and the like. Among others, a drum-type washing machine operates in a manner of using a frictional force between a drum, which is rotated by a driving force from a motor, and laundry, in a state of containing detergent, water and the laundry in the drum. In addition, the drum-type washing machine can have a washing effect of beating and rubbing laundry without making the laundry damaged or get tangled, resulting in a recent increase in a demand therefor.

On the other hand, the drum-type washing machine includes a cabinet configuring an external figure, a tub installed inside the cabinet, and a drum rotating with being accommodated in the tub and containing laundry therein.

In addition, a front cover is mounted at a front surface of the cabinet, and a door for opening/closing an inlet of the drum is mounted at an approximately central portion of the front cover. A control panel having a manipulating portion for inputting a washing condition and a display for showing the course of washing or the like is disposed on an upper portion of the front cover. A variety of control substrates and electric components are provided inside the control panel.

The manipulating portion for inputting the washing condition is configured in a shape of button or a type of dial knob rotated by a user to input such washing condition.

FIG. 1 is an enlarged perspective view showing general dial knob and knob deco mounted in a laundry machine.

As shown in FIG. 1, the general dial knob 10 according to the related art is mounted at a central portion or an edge of one side of the control panel.

In detail, the dial knob 10 includes a dial 11 grasped by a user for rotation so as to set a washing condition, and a knob guard 12 fixedly inserted in a control panel 15. The knob guard 12 has a front surface configured in an annular shape with a certain width. The knob guard 12 is also provided at its front surface with lamp window insertion grooves 14 in which lamp windows 13 are inserted.

The dial 11 is inserted into the central portion of the knob guard 12 in a direction inserted from a rear surface to a front surface. In more detail, the lamp window insertion grooves 14 are formed to have a certain interval therebetween. Several washing conditions are respectively printed on the control panel 15 on an outer circumferential surface of the knob guard 12, at points corresponding to the lamp windows 13. Lamps are mounted at rear surfaces of the lamp windows 13, such that light of the lamps can be emitted through the lamp windows 13.

Also, a lamp window main body (not shown) on which the lamp windows 13 are disposed is mounted at a rear surface of the knob guard 12. Here, the lamp window main body is mounted by being inserted in the rear surface of the knob guard 12. A transparent material is vacuum-deposited on the surface of the lamp window main body.

Here, each of the knob guard 12 and the lamp window main body is typically fabricated by an electroforming molding following by an injection process.

However, while assembling the knob guard 12 and the lamp window main body respectively fabricated by the injection molding, the transparent material vacuum-deposited on the lamp window main body has been fallen away. Furthermore, an inconvenience of the process of coupling the knob guard 12 to the lamp window main body has caused a decrease in productivity.

In recent time, laundry machines having a main body made of stainless steel for enhancing qualities of the products are interested in users. So, for the harmony with the stainless steel main body, the lamp windows 13 of the knob guard 12 also require the feel of such stainless steel.

SUMMARY OF THE INVENTION

Therefore, an object of the present invention is to provide a knob deco including a knob guard in which a dial knob is inserted, a lamp window main body mounted at a rear surface of the knob guard, and having lamp windows for transmitting light emitted from a rear side of the knob guard to a front side of the knob guard, and lamp window shielding members mounted at the corresponding lamp windows and configured to shield part of light transmitted through the lamp windows.

The lamp window shielding member is formed of a metal, preferably, stainless steel.

With such configuration, in case where a main body of the laundry machine having the knob deco disposed is formed of stainless steel, the main body and the knob deco can achieve a similar feel of a material and an aesthetic effect.

The lamp window shielding member is smaller than the lamp window when being seen from the front side of the knob guard. Accordingly, light can be leaked between the lamp window shielding member and the lamp window.

The lamp window shielding member is configured as a pin which penetrates through the lamp window or as a sheet partially inserted in the lamp window.

Here, the lamp window shielding member outwardly protrudes further than the lamp window, which thusly enhances a user's tactile sensation.

On the other hand, slots are further formed between the lamp window main body and the lamp windows. A rib protruded from the rear surface of the knob guard is inserted in each slot. The rib extends longer than the rear surface of the lamp window main body. As such, the implementation of the ribs and slots can reduce an interference between light emitted to neighboring lamp windows.

The knob guard is provided with a plurality of lamp window penetrating holes in which the lamp windows are inserted, and the surface of the knob guard having the lamp window penetrating holes is plated.

Here, it is effective to perform the plating such that it feels as if the surface of the knob guard is formed of stainless steel.

Hair lines are formed on the surface of the knob guard to provide the feel of a metal.

Separation preventing fringes are radially formed at an edge of a lower end of the knob guard, to avoid the knob guard from being stripped from the laundry machine.

The knob guard is formed of Acrylonitrile Butadiene Copolymer resin, and the lamp window main body is formed of acryl. The use of such materials allows the knob guard and the lamp window main body to be fabricated in an injection manner. Particularly, the lamp window main body is formed of the acryl to maintain its transparency.

In another aspect of the present invention, a method for manufacturing a knob deco includes injecting the knob guard, fixing the lamp window shielding members, and injecting the lamp window main body.

The step of injecting the knob guard uses an electroforming mold having hair lines formed at its central portion. As such, the use of the mold having the hair lines previously formed can reduce a separate process of generating the hair lines on the knob guard.

The step of injecting the lamp window main body is injected integrally with the knob guard and the lamp window shielding members. Thus, by integrally double-injecting the lamp window main body and the knob guard, a productivity can be improved.

The step of fixing the lamp window shielding members is configured to fix the lamp window shielding members by using jigs. It is appropriate when the lamp window shielding member is implemented as a pin.

The step of fixing the lamp window shielding member is configured to fix the lamp window shielding member to a lower or upper side of a mold, which is appropriate when the lamp window shielding member is implemented as a thin sheet.

Here, in case where the lamp window shielding member is fixed to the upper side of the mold, the lamp window shielding member is fixed thereto by using a vacuum adsorption or magnet. When the lamp window shielding member is fixed to the upper side of the mold using the magnet, the lamp window shielding member is formed of 400-series stainless steel, which is because the 400-series stainless steel among others is attracted to the magnet.

In an aspect of the present invention, a laundry machine includes a dial knob for inputting an operation condition of the laundry machine in a rotational manner, the knob deco having described above, and a control panel having the dial knob and the knob deco disposed thereat for allowing the input of the operation condition or a display of a operational state.

As stated above, the present invention can fabricate the knob guard and the lamp window main body by the double injection, which results in preventing an inconvenience that the knob guard and the lamp window main body are separately injected to thereafter be assembled with each other, thereby improving a productivity.

The present invention can also reduce a manufacturing cost of the knob deco by attaching the stainless steel only onto the lamp window portion without having to fabricate the entire knob deco by using the stainless steel for the harmony of the feel of the stainless steel main body and the knob deco.

Also, the present invention can enhance an overall aesthetic effect of the laundry machine having the stainless steel main body by installing the shielding members having the feel of the stainless steel on the lamp windows of the knob deco.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is an enlarged perspective view showing general dial knob and knob deco mounted at a laundry machine;

FIG. 2 is a front perspective view showing a dial knob and a knob deco in accordance with one exemplary embodiment of the present invention;

FIG. 3 is a plan view of the knob deco of FIG. 2;

FIG. 4 is a rear view of a knob guard configuring the knob deco of FIG. 2;

FIG. 5 is a rear view of the knob deco in a state where the knob guard of FIG. 4 is coupled to a lamp window main body;

FIG. 6 is a perspective view of the lamp window main body of FIG. 5;

FIG. 7 is a cross-sectional view taken along the line VII-VII of FIG. 5;

FIG. 8 is a view showing a procedure of forming the knob deco in accordance with the one exemplary embodiment of the present invention;

FIG. 9 is a flowchart showing a manufacturing procedure of the knob deco of FIG. 8;

FIG. 10*a* is a cross-sectional view showing one example as to how to fix a lamp window shielding member to the knob guard of FIG. 4; and FIG. 10*b* is a cross-sectional view showing another example as to how to fix the lamp window shielding member to the knob deco of FIG. 4.

DETAILED DESCRIPTION OF THE INVENTION

Description will now be given in detail of configuration and operation in accordance with one exemplary embodiment of the present invention, with reference to the accompanying drawings.

FIG. 2 is a front perspective view showing a dial knob and a knob deco in accordance with one exemplary embodiment of the present invention, and FIG. 3 is a plan view of the knob deco of FIG. 2.

As shown in FIGS. 2 and 3, the knob deco 100 in accordance with one exemplary embodiment of the present invention may include a knob guard 120 having a dial knob 110 inserted therein, a lamp window main body (not shown) disposed at a rear surface of the knob guard 120 and having lamp windows 141 for transmitting light emitted from a rear side of the knob guard 120 to a front side of the knob guard 120, and lamp window shielding members 130 mounted on the corresponding lamp windows 141 for shielding part of light transmitted through the lamp windows 141.

Hereinafter, description will be given under the assumption that the knob deco 100 is used in a drum-type washing machine, one of the laundry machine, and the other configuration of the drum-type washing machine excluding the knob deco 100 is the same to the configuration of the typical drum-type washing machine, description of which will thusly be omitted.

On the other hand, a separation preventing fringe 121 for preventing the knob deco 100 from being stripped from the control panel (See 15 of FIG. 1) of the laundry machine is formed at an edge of a lower end of the knob guard 120. Here, it may be effective for a plurality of separation preventing fringes 121 to be radially formed with a certain interval therebetween. That is, the plurality of separation preventing fringes 121 are spaced apart with the certain interval, which facilitates the knob deco 100 to be mounted at the control panel (See 15 of FIG. 1).

Here, it is effective that the lamp window shielding member 130 is formed of a metal, so as to be harmonious with the metallic feel of the control panel at which the knob guard 120 is installed. If the control panel 15 having the knob guard 120 is formed of stainless steel, the shielding member 130 is also formed of the stainless steel to be harmonious.

In addition, the surface of the knob guard 120 may have hair lines formed thereon or be applied with a metal plating, thus to be harmonious with the material or the feel of the surface of the control panel 15 at the laundry machine having the knob guard 120. That is, in order to provide the feel of the metal on the surface of the knob guard 120, such hair lines are formed or the metal plating is applied.

Here, the knob guard 120 may be injected. Preferably, the knob guard 120 is injected by using Acrylonitrile Butadiene Copolymer resin.

FIG. 4 is a rear view of a knob guard configuring the knob deco of FIG. 2, FIG. 5 is a rear view of the knob deco in a state where the knob guard of FIG. 4 is coupled to a lamp window main body, and FIG. 6 is a perspective view of the lamp window main body of FIG. 5.

As shown in FIGS. 4 and 5, a mounting portion 125 for mounting the lamp window main body 140 is recessed in a rear surface of the knob guard 120. The mounting portion 125 is recessed in the circumference of the knob guard 120.

In the meantime, the mounting portion 125 is provided with a plurality of lamp window penetrating holes 123, and ribs 124 are formed between the lamp window penetrating holes 123. Here, the lamp windows 141 of the lamp window main body 140 are disposed through the lamp window penetrating holes 123.

Also, the rib 124 protrudes through the mounting portion 125. Thus, the rib 124 preferably extends to be longer than the rear surface of the lamp window main body 140 mounted at the mounting portion 125. Such rib 124 can be configured to reduce a permeation of light emitted from each light source (not shown), which is disposed at the rear side of the lamp window 141, into neighboring lamp windows 141 or an interference between light.

As shown in FIG. 6, the lamp window main body 140 includes a plurality of lamp windows 141, and slots 142 formed between neighboring lamp windows 141. The lamp window main body 140 is preferably formed in a hoof-like shape or an annular shape having one end open. The slots 142 are formed by a laser cutting.

Here, the ribs 124 protruding from the mounting portion 125 recessed in the rear surface of the knob guard 120 are inserted in the slots 142. The lamp window main body 140 is formed of a transparent material to allow a transmission of light. Concerning a manufacturing method, it is effective for the lamp window main body 140 to be formed of acryl.

The lamp window shielding member 130 is disposed on the lamp window 141. Hereinafter, a coupled state of the lamp window shielding members 130, the lamp windows 141 and lamp window penetrating holes 123 will be described with reference to FIG. 7.

FIG. 7 is a cross-sectional view taken along the line VII-VII of FIG. 5.

As shown in FIG. 7, preferably, the lamp window 141 is smaller than the lamp window penetrating hole 123 of the knob guard 120, and the lamp window shielding member 130 is smaller than the lamp window 141.

Here, the lamp window main body 140 is formed of transparent acryl, and accordingly light emitted from the light source (not shown) disposed at the rear side of the lamp window main body 140 transmits through the lamp window main body 140, thus to be spread to the front side of the knob guard 120.

In order to increase a visual effect of such light, the lamp window shielding member 130 which is smaller than the lamp window 141 is mounted on the lamp window 141, thereby allowing light to be leaked out of the periphery of the lamp window shielding member 130. In addition, if the lamp window shielding member 130 is formed of a metal, the light leaked out of the periphery of the lamp window shielding member 130 is reflected on the lamp window shielding member 130 formed of a metal. Accordingly, the visual effect of the knob deco 100 can be implemented and also a user can clearly recognize the function of the laundry machine indicated by the dial knob 110.

On the other hand, the lamp window shielding member 130 preferably protrudes further than the lamp window 141 or to the front side of the knob guard 120 because light can be reflected by using the side surface of the protruded shielding member 130.

Referring to FIG. 7, the knob guard 120, the lamp window main body 140 and the lamp window shielding member 130 are almost integrally assembled with each other without being spaced apart. Hereinafter, a manufacturing method of the knob deco 100 will be described.

FIG. 8 is a view showing a procedure of manufacturing the knob deco in accordance with the one exemplary embodiment of the present invention, and FIG. 9 is a flowchart showing a manufacturing procedure of the knob deco of FIG. 8.

As shown in FIGS. 8 and 9, the knob deco 100 in accordance with the one exemplary embodiment of the present invention can be fabricated by performing the steps of injecting the knob guard 120 (S100), fixing the lamp window shielding members 130 (S200), and injecting the lamp window main body 140 (S300).

Here, the step (S100) of injecting the knob guard 120 uses an electroforming mold having hair lines formed thereon. Here, the electroforming mold is configured with an upper mold and a lower mold. The hair lines are formed on the electroforming mold to correspond to the surface having the lamp window penetrating holes 123 of the knob guard 120. Accordingly, a process of forming such hair lines on the surface after the injection of the knob guard 120 cannot separately be performed, resulting in an increase in productivity.

The hair line literally forms a fine unevenness with a thickness of hair. A pitch of the hair line is approximately 0.2 mm, which allows an effective expression of metallic feel.

Also, the surface of the knob guard 120 may be applied with a nickel plating or the like so as to achieve the feel of the metal. Such nickel plating may be applied after the step (S100) of injecting the knob guard 120 or after the step (S300) of injecting the lamp window main body 140.

Such nickel plating is applied on the surface having the hair lines, whereas a glossy plating is applied on the surface of the knob guard 120 without having the hair lines.

In the meantime, the step (S200) of fixing the lamp window shielding member 130 is performed by fixing the shielding members 130 using jigs (not shown). Other fixing manner may be employed according to the shape of the shielding member 130, which will be described with reference to FIGS. 10*a* and 10*b*.

FIG. 10*a* is a cross-sectional view showing one example as to how to fix a lamp window shielding member to the knob guard of FIG. 4, and FIG. 10*b* is a cross-sectional view showing another example as to how to fix the lamp window shielding member to the knob deco of FIG. 4.

As shown in FIG. 10*a*, it can be noticed that a lamp window shielding member 130' is implemented as a pin having a certain length. As such, in case where the shielding member 130' is configured as a pin, a pin portion 131 having a certain length is fixed to a lower mold 150, thereafter to inject the lamp window main body 140.

In case where a lamp window shielding member 130" is configured as a plate or sheet which is thin in thickness, it is preferable to fix the shielding member 130" to an upper mold as shown in FIG. 10*b*. Here, the sheet-like shielding member 130" is partially inserted in the lamp window 141. Here, it is appropriate that the thickness of the shielding member 130" is 1.0 mm and a diameter thereof is 2.5 mm. Such measurement of the shielding member 130" must be determined by concerning the height or diameter of the lamp window penetrating hole 123 or the lamp window 141.

Still referring to FIG. 10*b*, in case of fixing the sheet-like shielding member 130" to the upper mold, since the shielding member 130" is thin and small and accordingly a jig cannot be used, a vacuum adsorption or magnet is used. That is, an adsorbing unit or a magnet for generating a strong adsorption force or magnetic attraction is disposed at a rear side of the shielding member 130" thereby to fix the shielding member 130" to the upper mold.

Here, in case of using the magnet, the lamp window shielding member 130" should be formed of a material which the magnet can attract. In particular, if the lamp window shielding member 130" is formed of stainless steel, a 400-series stainless steel which the magnet can attract should be used.

As such, after the step (S100) of injecting the knob guard 120 and the step (S200) of fixing the lamp window shielding member 130, the step (S300) of injecting the lamp window main body 140 is followed, thereby finally manufacturing the knob deco 100.

The step (S300) of injecting the lamp window main body 140 is performed after the lamp window shielding member 130 is fixed to the knob guard 120. Accordingly, a double injection or bi-injection is performed to integrally implement the knob deco 100. The double injection can avoid the inconvenience that the lamp window main body 140 and the knob guard 120 are separately injected and thereafter assembled with each other.

Here, pigments with a variety of colors are mixed with the molding of the lamp window main body 140, to obtain various light transmission effects. In addition, it is allowed that light with different colors can be transmitted through each lamp window 141 which indicates the function of the laundry machine in cooperation with the rotation of the dial knob 110, which enhances a visual effect as well as making a user definitely recognize the function of the laundry machine.

In the meantime, a laundry machine according to the present invention includes a dial knob 110 for allowing an input of an operation condition of the laundry machine, a knob deco 100 disposed at the periphery of the dial knob 110, and a control panel (See 15 in FIG. 1) having the dial knob 110 and the knob deco 100 disposed thereat and allowing the input of the operation condition or a display of an operational state.

It is apparent that the knob deco and a manufacturing method thereof according to the scope of the present invention can be applied to various types of laundry machine, such as a dryer, a drum-type washing machine compatible with a drying, a combined washing system, a refresher and the like, as well as the drum-type washing machine.

In addition, the aforesaid knob deco and the manufacturing method thereof may not be limited to the laundry machine formed of stainless steel. However, it should be understood as a technical scope of the present invention which can be interpreted from various perspectives or a minimum technique for the knob deco and the manufacturing method thereof according to present invention, and also it should not be construed as limiting the present invention.

As the present features may be embodied in several forms without departing from the characteristics thereof, it should also be understood that the above-described exemplary embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A knob of a laundry machine, comprising:

a knob guard;

a dial knob inserted in the knob guard;

a lamp window main body mounted at a rear surface of the knob guard, the lamp window main body comprising a plurality of lamp windows formed therein for transmitting light emitted from a rear side of the knob guard to a front side of the knob guard; and a plurality of lamp window shielding members respectively installed on the plurality of lamp windows and configured to partially shield light transmitted through the plurality of lamp windows.

2. The knob of claim 1, wherein each of the plurality of lamp window shielding members is disposed at a front surface of a corresponding lamp window of the plurality of lamp windows.

3. The knob of claim 1, wherein each of the plurality of lamp window shielding members is formed of a metal.

4. The knob of claim 2, wherein each of the plurality of lamp window shielding members is smaller than its respective lamp window, when viewed from the front side of the knob guard.

5. The knob of claim 1, wherein each of the plurality of lamp window shielding members is configured as a pin which penetrates through the lamp window.

6. The knob of claim 1, wherein each of the plurality of lamp window shielding members is configured as a sheet that is partially inserted in its respective lamp window.

7. The knob of claim 1, wherein each of the plurality of lamp window shielding members is formed of stainless steel.

8. The knob of claim 1, wherein each of the plurality of lamp window shielding members protrudes outward beyond its respective lamp window.

9. The knob of claim 1, wherein the lamp window main body further comprises a plurality, of slots respectively formed between neighboring lamp windows.

10. The knob of claim 9, wherein each of the plurality of slots accommodates a corresponding rib that protrudes from the rear surface of the knob guard, the rib extending beyond a rear surface of the lamp window main body.

11. The knob of claim 1, wherein the knob guard includes a plurality of lamp window penetrating holes formed in a surface therein in which the plurality of lamp windows are respectively inserted, wherein the surface of the knob guard having the plurality of lamp window penetrating holes formed therein is plated.

12. The knob of claim 11, wherein the surface of the knob guard having the plurality of lamp window penetrating holes formed therein has hair lines formed thereon.

13. The knob of claim 1, wherein the knob guard is formed of Acrylonitrile Butadiene Copolymer resin, and the lamp window main body is formed of acryl.

14. A method for manufacturing a knob of a laundry machine including a knob guard in which a dial knob is inserted, a lamp window main body provided at a rear surface of the knob guard and having lamp windows formed therein, and lamp window shielding members mounted at corresponding lamp windows so as to partially shield light transmitted through the lamp windows, the method comprising:

injection molding the knob guard;

fixing the lamp window shielding members in place relative to the knob guard; and injection molding the lamp window main body.

15. The method of claim 14, wherein injection molding the knob guard comprises using an electroforming mold having hair lines formed thereon.

16. The method of claim 14, wherein injection molding the lamp window main body is performed after the lamp window shielding members are fixed to the knob guard.

17. The method of claim 14, wherein fixing the lamp window shielding members comprises fixing the lamp window shielding members using jigs.

18. The method of claim 14, wherein fixing the lamp window shielding members comprises fixing the lamp window shielding members to a lower side or an upper side of a mold.

19. The method of claim 18, wherein fixing the lamp window shielding members comprises fixing the lamp window shielding members to the upper side of the mold using vacuum adsorption or magnets.

20. The method of claim 19, wherein the lamp window shielding members are formed of 400-series stainless steel when fixing the lamp window shielding members to the upper side of the mold using magnets.

21. The method of claim 14, wherein injection molding the lamp window main body comprises injection molding the lamp window main body at the rear surface of the knob guard so as to secure the knob guard, the lamp window shielding members and the lamp window main body together as a single unit.

22. The knob of claim 1, wherein each of the plurality of lamp window shielding members is positioned its respective lamp window such that an outer peripheral portion of the lamp window extends beyond and surrounds an outer periphery of the lamp window shielding member, such that light emitted at the rear side of the knob guard is transmitted only through the outer peripheral portion of the lamp window to the front side of the knob guard.

23. A knob of a laundry machine, comprising:

a knob guard in which a dial knob is inserted;

a lamp window main body mounted at a rear surface of the knob guard, the lamp window main body comprising:

lamp windows formed therein for transmitting light emitted from a rear side of the knob guard to a front side of the knob guard; and slots respectively formed between neighboring lamp windows, wherein each of the slots accommodates a rib that protrudes from the rear surface of the knob guard and extending beyond a rear surface of the lamp window main body; and lamp window shielding members mounted at the corresponding lamp windows and configured to partially shield light transmitted through the lamp windows.

* * * * *

UNITED STATES PATENT AND TRADEMARK OFFICE

CERTIFICATE OF CORRECTION

PATENT NO. : 7,878,669 B2
APPLICATION NO. : 12/202783
DATED : February 1, 2011
INVENTOR(S) : Jang et al.

It is certified that error appears in the above-identified patent and that said Letters Patent is hereby corrected as shown below:

On Title page

Item (73) Assignee: delete "~~LG Electrnics Inc.,~~" and insert -- LG Electronics Inc., Seoul (KR) --

Signed and Sealed this
Seventh Day of June, 2011

David J. Kappos

David J. Kappos
*Director of the United States Patent and Trademark Office*